US012733779B2

(12) United States Patent
Choi et al.

(10) Patent No.: US 12,733,779 B2
(45) Date of Patent: Sep. 15, 2026

(54) CLEANER

(71) Applicant: SAMSUNG ELECTRONICS CO., LTD., Suwon-si (KR)

(72) Inventors: Jiwon Choi, Suwon-si (KR); Taegwang Kim, Suwon-si (KR); Byoungin Lee, Suwon-si (KR); Dongwoo Ha, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 519 days.

(21) Appl. No.: 18/075,902

(22) Filed: Dec. 6, 2022

(65) Prior Publication Data

US 2023/0248195 A1 Aug. 10, 2023

Related U.S. Application Data

(63) Continuation of application No. PCT/KR2022/016459, filed on Oct. 26, 2022.

(30) Foreign Application Priority Data

Feb. 9, 2022 (KR) ..... 10-2022-0016785

(51) Int. Cl.
*A47L 9/04* (2006.01)
*A47L 5/30* (2006.01)

(52) U.S. Cl.
CPC ..... *A47L 9/0466* (2013.01); *A47L 5/30* (2013.01)

(58) Field of Classification Search
CPC . A47L 9/02; A47L 9/04; A47L 9/0405; A47L 9/0411; A47L 9/0461;

(Continued)

(56) References Cited

U.S. PATENT DOCUMENTS 1,953,340 A * 4/1934 Doemling ..... A47L 5/30 310/67 R
6,314,611 B1 * 11/2001 Sauers ..... A47L 9/0455 15/376

(Continued)

FOREIGN PATENT DOCUMENTS

CN 1235808 A 11/1999
CN 111281267 A * 6/2020 ..... A47L 9/04

(Continued)

OTHER PUBLICATIONS

CN-112842135 Espacenet Translation; Cleaning Head Brush Rod, Cleaning Head And Dust Collector; Wu, Xiao-ming; May 28, 2021 (Year: 2021).*

(Continued)

*Primary Examiner* — Brian D Keller
*Assistant Examiner* — Sidney D Full
(74) *Attorney, Agent, or Firm* — STAAS & HALSEY LLP

(57) ABSTRACT

A cleaner includes: a main body; a connection pipe having one end connectible to the main body; and a brush head connectible to an other end of the connection pipe The brush head includes: an suction inlet formed therein, a drum brush detachably installed inside the brush head, a driver configured to drive the drum brush; a suction chamber formed inside the brush head and communicating with the suction inlet; a first cover covering one side of the brush head, the first cover having an inlet formed therein and through which air enters inside of the drum brush is formed in the first cover; and a second cover covering an other side of the brush head to seal inside of the brush head, the second cover having an outlet duct formed therein through which air cooled the inside of the drum brush is discharged to the suction chamber.

17 Claims, 16 Drawing Sheets

(58) Field of Classification Search
CPC .... A47L 9/0466; A47L 9/0477; A47L 9/0483; A47L 9/06; A47L 9/2889; A47L 5/30
USPC .. 15/340.3, 366, 383, 256.5, 256.51, 256.52
See application file for complete search history.

(56) References Cited

U.S. PATENT DOCUMENTS

| | | | | |
|---|---|---|---|---|
| 6,437,465 | B1 | 8/2002 | Nishimura et al. | |
| 8,898,858 | B2 | 12/2014 | Dyson et al. | |
| 11,771,284 | B2 | 10/2023 | Pruiett et al. | |
| 11,877,715 | B2 | 1/2024 | Kim et al. | |
| 2005/0160555 | A1* | 7/2005 | Mayes | A47L 9/0488 15/384 |
| 2007/0113372 | A1 | 5/2007 | McCormick et al. | |
| 2013/0212832 | A1* | 8/2013 | Genn | A47L 9/2889 15/383 |

FOREIGN PATENT DOCUMENTS

| | | | | | |
|---|---|---|---|---|---|
| CN | 112842135 | A | * | 5/2021 | A47L 9/0477 |
| DE | 2 406 044 | A | | 3/2005 | |
| GB | 2543314 | A | * | 4/2017 | A47L 9/0416 |
| GB | 2572432 | A | * | 10/2019 | A47L 9/0081 |
| JP | 2000-60777 | | | 2/2000 | |
| JP | 2000-308608 | | | 11/2000 | |
| KR | 2002-0042411 | | | 6/2002 | |
| KR | 10-0438607 | | | 7/2004 | |
| KR | 10-1662045 | | | 10/2016 | |
| KR | 20180118026 | A | * | 10/2018 | A47L 9/04 |
| KR | 10-1962160 | | | 3/2019 | |
| KR | 10-2021-0020780 | | | 2/2021 | |
| KR | 10-2021-0073460 | | | 6/2021 | |

OTHER PUBLICATIONS

GB-2543314 Espacenet Translation; Cleaner Head for a Vacuum Cleaner; Craig Thomas Wilkinson; Apr. 19, 2017 (Year: 2017).*
Espacenet Translation KR-20180118026; Vacuum Cleaner; Yang in Gyu; Oct. 30, 2018 (Year: 2018).*
PE2E Translation GB-2572432; Suction Nozzle; Daniel Martin Taylor; Oct. 2, 2019 (Year: 2019).*
CN-111281267 Espacenet Translation; Zha, Xiao-liang; Floor Brush and Cleaning Device; Jun. 16, 2020 (Year: 2020).*
International Search Report dated Feb. 14, 2023 issued in PCT Application No. PCT/KR2022/016459.
Written Opinion dated Feb. 14, 2023 issued in PCT Application No. PCT/KR2022/016459.
Supplementary European Search Report dated Jun. 5, 2025 issued in European Application No. EP 22 92 6179.
Office Action dated Feb. 12, 2026, issued in European Application No. 22 926 179.7.

* cited by examiner

CLEANER

CROSS-REFERENCE TO RELATED APPLICATION

This application is a continuation application, filed under 35 U.S.C. § 111(a), of International Application PCT/KR2022/016459 filed Oct. 26, 2022, and is based on and claims priority under 35 U.S.C. § 119 to Korean Patent Application No. 10-2022-0016785, filed on Feb. 9, 2022 in the Korean Intellectual Property Office, the disclosure of which is incorporated by reference herein in its entirety.

BACKGROUND

1. Field

The disclosure relates to a cleaner having a cooling structure capable of efficiently cooling heat generated from a driver for driving a drum brush, wherein the driver is provided inside the drum brush.

2. Description of the Related Art

A cleaner is an appliance for removing rubbish for cleaning. At home, vacuum cleaners are generally and widely used. A vacuum cleaner cleans an indoor space by sucking air with a suction force of a fan motor unit and then separating rubbish from the sucked air through a device such as a filter or the like. Vacuum cleaners are classified into a canister type, an upright type, a stick type, and a robot type. Recently, a robot cleaner that itself travels on a cleaning area without a user's control to perform a cleaning task by sucking rubbish such as dust from a floor to be cleaned is popularized.

The vacuum cleaner includes a main body, and a brush head connected with the main body to suck foreign materials from a floor to be cleaned with a suction force of air.

The brush head includes a housing having a suction inlet, and a drum brush rotatably provided inside the housing to induce foreign materials existing on a floor to be cleaned to be efficiently sucked into the suction inlet.

The drum brush is driven by a driver. The driver is installed inside the drum brush to reduce the size of the brush head. While the driver installed inside the drum brush operates, heat is generated inside the drum brush.

Accordingly, a cooling structure for efficiently cooling heat generated inside the drum brush is needed.

SUMMARY

Therefore, it is an aspect of the disclosure to provide a cleaner having a cooling structure capable of efficiently cooling heat generated inside a drum brush by a driver provided inside the drum brush to drive the drum brush.

Additional aspects of the disclosure will be set forth in part in the description which follows and, in part, will be obvious from the description, or may be learned by practice of the disclosure.

A cleaner according to an embodiment of the disclosure includes: a main body; a connection pipe having one end connectible to the main body; and a brush head connectible to an other end of the connection pipe, the brush head comprising an suction inlet is formed therein a drum brush detachably installed inside the brush head, a driver installed inside the drum brush and configured to drive the drum brush; a suction chamber formed inside the brush head and communicating with the suction inlet; a first cover covering one side of the brush head, the first cover having an inlet formed therein and through which air enters inside of the drum brush is formed in the first cover; and a second cover covering the other side of the brush head to seal inside of the brush head, the second cover having an outlet duct formed therein and through which air cooled the inside of the drum brush is discharged to the suction chamber.

According to an operation of a suction motor installed inside the main body and configured to generate a suction force, negative pressure may be formed inside the suction chamber, outside air of the brush head may enter the brush head through the inlet by the negative pressure formed inside the suction chamber to cool the inside of the drum brush, and then the outside air may be discharged to the suction chamber through the outlet duct.

The inlet may be formed as a plurality of holes, and an internal flow path of the brush head may be formed as a serial type flow path along which outside air of the brush head enters the inlet, cools the inside of the drum brush, and then is discharged to the suction chamber through the outlet duct.

An impeller configured to improve a flow of air entered the inlet and passing through the inside of the drum brush may be provided inside the drum brush.

The drum brush may include a pair of holders detachably assembled with both sides of the drum brush.

The pair of holders may include a first holder detachably assembled with one side of the drum brush, and adjacent to the first cover, the first holder and coupled with the driver, and a second holder detachably assembled with an other side of the drum brush, and adjacent to the second cover, the second holder and coupled with the impeller.

The drum brush may include a brush formed with villus and formed in a shape of a cylinder to surround an outer circumferential surface of the drum brush.

Each of the first holder and the second holder may include a bent portion overlapping a portion of one side of the brush and bent toward the brush in an axial direction of the drum brush.

The impeller may rotate at a same rotation velocity as a rotation velocity of the drum brush upon a rotation of the drum brush.

The cleaner may further include an outlet configured to enable the outlet duct to communicate with the suction chamber and discharge air passed through the outlet duct to the suction chamber.

The outlet may be formed in the second cover forming a portion of side walls of the suction chamber.

The outlet may be formed in a side wall of the brush head, the side wall forming a portion of side walls of the suction chamber.

The second cover may include a guide protruding in an axial direction of the drum brush and configured to prevent the drum brush from interfering with the outlet.

The outlet may be formed in a shape of a circle.

The outlet may be formed in a shape of a polygon.

BRIEF DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION

Figure 1:
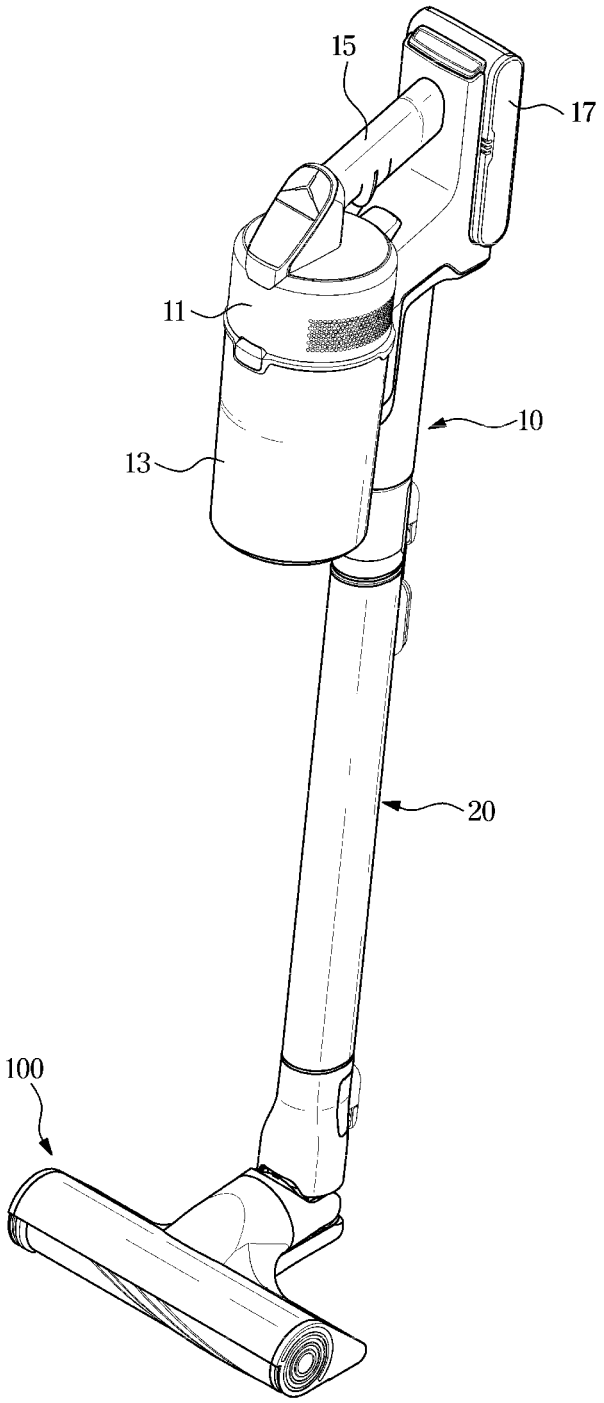
FIG. 1 shows a cleaner according to an embodiment of the disclosure.

Embodiments described in the present specification are only the preferred embodiments of the disclosure, and thus it is to be understood that various equivalents or modified examples, which may replace the embodiments, are included in the scope of rights of the disclosure when filing the present application.

Also, like reference numerals or symbols denoted in the drawings of the present specification represent members or components that perform the substantially same functions.

Also, the terms used in the present specification are merely used to describe embodiments, and are not intended to limit and/or restrict the disclosure. An expression used in the singular encompasses the expression of the plural, unless it has a clearly different meaning in the context. In the present specification, it is to be understood that the terms such as "comprising", "including" or "having", etc., are intended to indicate the existence of the features, numbers, steps, operations, components, parts, or combinations thereof disclosed in the specification, and are not intended to preclude the possibility that one or more other features, numbers, steps, operations, components, parts, or combinations thereof may exist or may be added.

Also, it will be understood that, although the terms including ordinal numbers, such as "first", "second", etc., may be used herein to describe various components, these components should not be limited by these terms. These terms are only used to distinguish one component from another. For example, a first component could be termed a second component, and, similarly, a second component could be termed a first component, without departing from the scope of the present disclosure. As used herein, the term "and/or" includes any and all combinations of one or more of associated listed items.

Meanwhile, in the following description, the terms "front end", "rear end", "upper portion", "lower portion", "front surface", "rear surface", "front end", "lower end", etc. are defined based on the drawings, and the shapes and positions of the components are not limited by the terms.

Throughout the disclosure, the expression "at least one of a, b or c" indicates only a, only b, only c, both a and b, both a and c, both b and c, all of a, b, and c, or variations thereof.

Hereinafter, embodiments of the disclosure will be described in detail with reference to the accompanying drawings.

Figure 2:
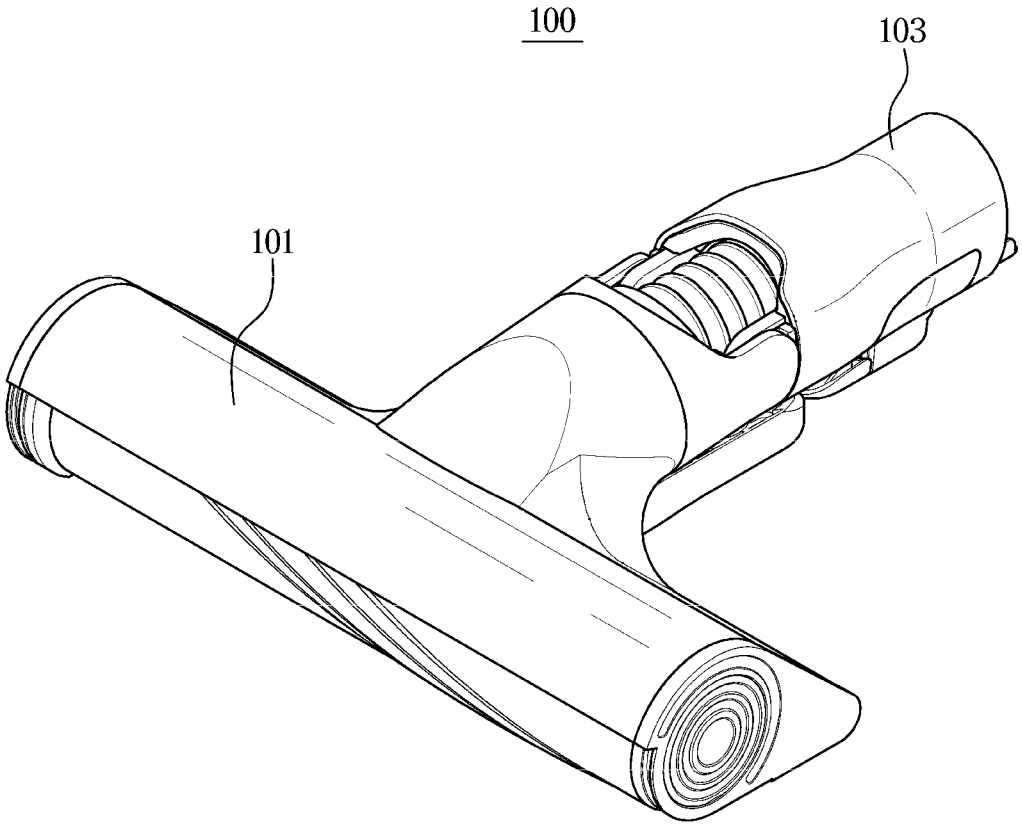
FIG. 2 shows a brush head of a cleaner according to an embodiment of the disclosure.
Figure 3:
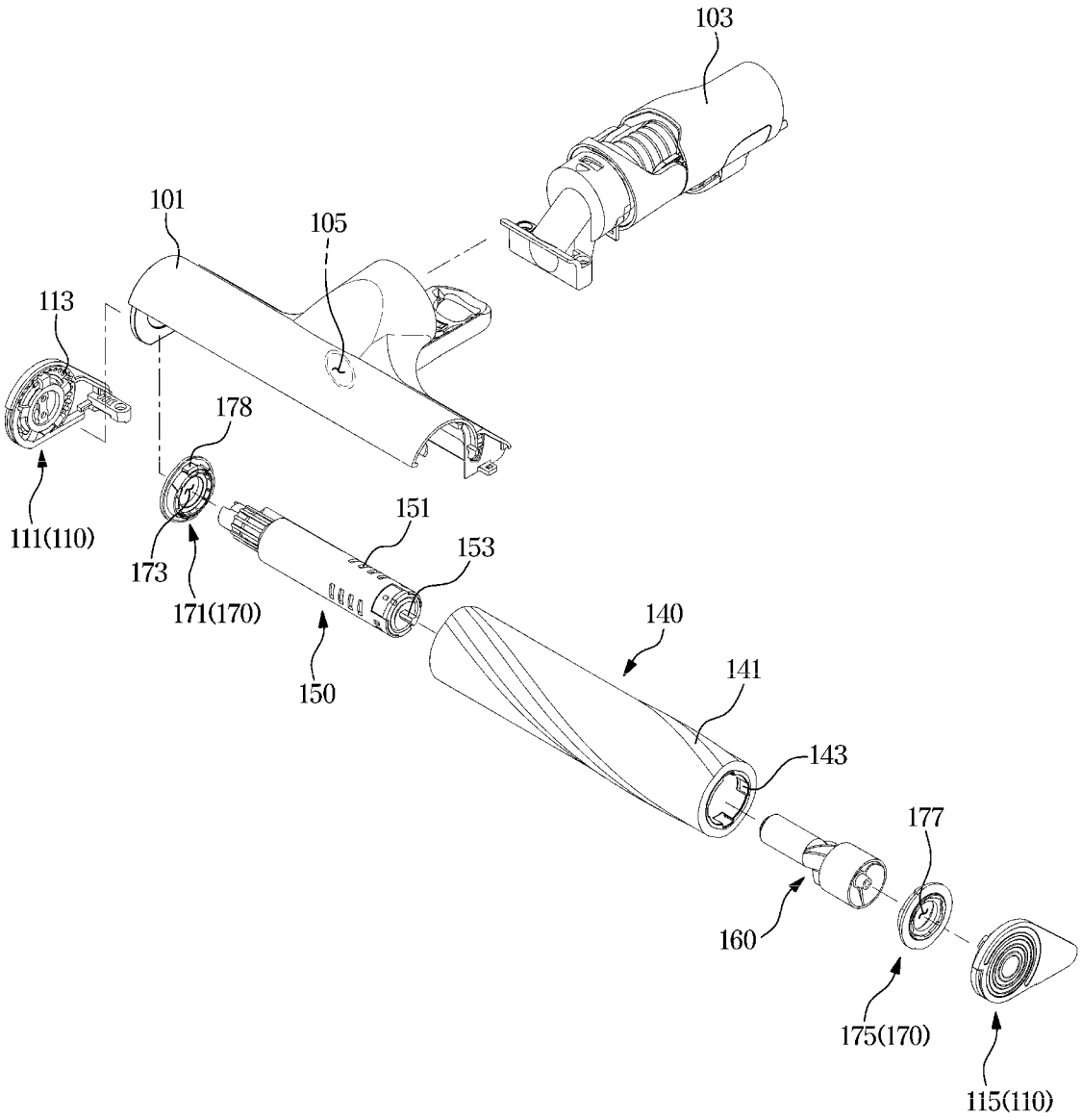
FIG. 3 is an exploded view of a brush head of a cleaner according to an embodiment of the disclosure.

FIG. 1 shows a cleaner according to an embodiment of the disclosure. FIG. 2 shows a brush head of a cleaner according to an embodiment of the disclosure. FIG. 3 is an exploded view of a brush head of a cleaner according to an embodiment of the disclosure.

As shown in FIGS. 1 to 3, a cleaner may include a main body 10, and a brush head 100 connected with the main body 10 and configured to suck a foreign material existing on a floor to be cleaned with a suction force of air.

The main body 10 may include a suction motor 11 for generating a suction force, a foreign material collecting room 13 for separating a foreign material from sucked air and collecting the foreign material, a handle 15 that is gripped by a user to use the cleaner, and a battery 17 for supplying power to the suction motor 11.

The suction motor 11 for generating a suction force may convert an electric force to a mechanical rotation force. A device for generating a suction force may include, in addition to the suction motor 11, a fan connected with the suction motor 11 and configured to rotate, which is not shown in the drawings. The foreign material collecting room 13 may collect a foreign material through a cyclone method for separating a foreign material by using a centrifugal force or a dust bag method for passing air through a filter bag to separate a foreign material from the air. Air from which a foreign material has been removed through the foreign material collecting room 13 may be discharged to outside of the main body 10.

The brush head 100 may be connected with the main body 10 by a connecting pipe 20. The connecting pipe 20 may be a pipe having certain stiffness or a flexible hose. The connecting pipe 20 may transfer a suction force generated by the suction motor 11 to the brush head 100, and guide air and a foreign material sucked through the brush head 100 to the main body 10.

The brush head 100 may closely contact a floor to be cleaned and suck air and a foreign material on the floor to be cleaned. The brush head 100 may be rotatably coupled with the connecting pipe.

The brush head 100 may include a housing 101 having a suction inlet 105. The housing 101 may be connected with the connecting pipe 20 by a connector 103. As a result of generation of a suction force according to an operation of the suction motor 11, a foreign material existing on the floor to be cleaned may be sucked into the suction inlet 105 together with air. The air and foreign material sucked into the suction inlet 105 may be discharged to the outside of the housing 101 via the connector 103.

The brush head 100 may include a cover 110 covering both sides of the brush head 100. The cover 110 may cover both sides of the housing 101.

The cover 110 may include a first cover 111 covering one side of the brush head 100. The cover 110 may include a second cover 115 covering the other side of the brush head 100, which is opposite to the one side of the brush head 100. The second cover 115 may cover the other side of the brush head 100 to seal inside of the brush head 100. That is, the second cover 115 may block the inside of the brush head 100 from the outside. Details about the first cover 111 and the second cover 115 will be described below.

The brush head 100 may include a suction chamber 120 (see FIGS. 12 and 13) formed inside the brush head 100 and communicating with the suction inlet 105. The suction chamber 120 may be formed in a space between the housing 101 and a drum brush 140 inside the brush head 100. According to an operation of the suction motor 11, negative pressure may be formed inside the suction chamber 120.

The brush head 100 may include the drum brush 140 detachably installed inside the brush head 100. That is, the drum brush 140 may be detachably installed inside the housing 101. The drum brush 140 may be rotatably installed inside the brush head 100. The drum brush 140 may be rotatably installed inside the brush head 100 to induce a foreign material existing on a floor to be cleaned to be efficiently sucked into the suction inlet 105.

Inside the drum brush 140, a driver 150 for driving the drum brush 140 to rotate the drum brush 140 may be provided. Because the driver 150 is provided inside the drum brush 140, an inside space of the brush head 100 may be efficiently used. That is, because the driver 150 provided inside the drum brush 140 reduces an inside space of the brush head 100 by a space occupied by the driver 150, the size of the brush head 100 may be reduced. By reducing the size of the brush head 100, a weight of the brush head 100 may also be reduced.

The driver 150 may be adjacent to the first cover 111 covering the one side of the brush head 100. The driver 150 may include an exhaust hole 151 through which air entered inside of the driver 150 and cooled the driver 150 is discharged from the driver 150. The exhaust hole 151 may be a plurality of holes. The driver 150 may include a rotation shaft 153 connected with the impeller 160 which will be described below to rotate the impeller 160.

Because the driver 150 is installed inside the drum brush 140, heat may be generated inside the drum brush 140 by the driver 150. To discharge heat generated inside the drum brush 140 to the outside, the impeller 160 may be provided inside the drum brush 140. Details about the impeller 160 will be described below.

The drum brush 140 may include a pair of holders 170 detachably assembled respectively with both sides of the drum brush 140. The pair of holders 170 may include a first holder 171 detachably assembled with the one side of the drum brush 140, being adjacent to the first cover 111. The driver 150 may be coupled with the first holder 171. In the drawings, the driver 150 is shown to be coupled with the first holder 171, although not limited thereto. That is, the driver 150 and the first holder 171 may be integrated into one body. In the first holder 171, a first opening 173 may be formed to communicate with the inside of the drum brush 140. The first opening 173 may communicate with the inside of the driver 150.

The pair of holders 170 may include a second holder 175 detachably assembled with the other side of the drum brush 140, being adjacent to the second cover 115. The impeller 160 may be coupled with the second holder 175. In the drawings, the impeller 160 is shown to be coupled with the second holder 175, although not limited thereto. That is, the impeller 160 and the second holder 175 may be integrated into one body. In the second holder 175, a second opening 177 may be formed to communicate with the inside of the drum brush 140. The second opening 177 may communicate with the impeller 160.

Figure 4:
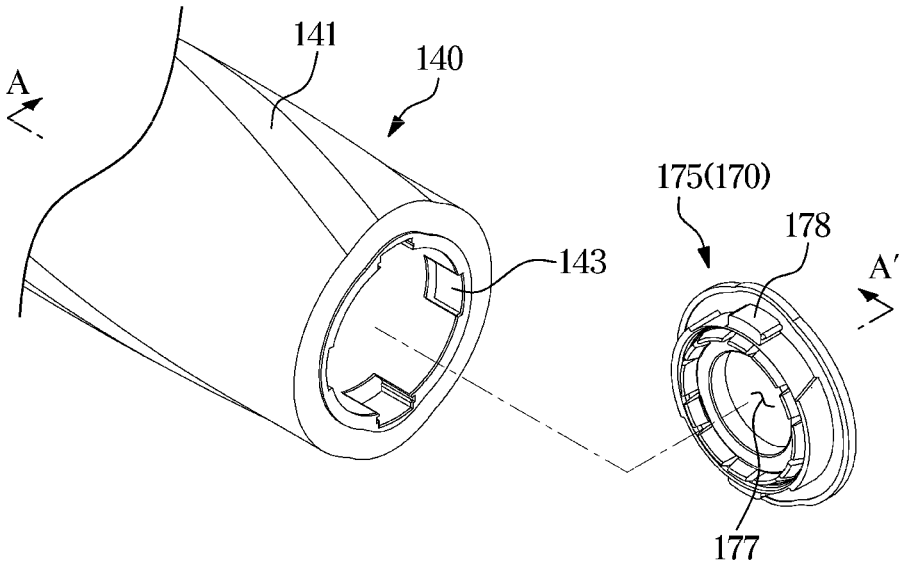
FIG. 4 shows a state in which a holder is assembled into a drum brush, according to an embodiment of the disclosure.
Figure 5:
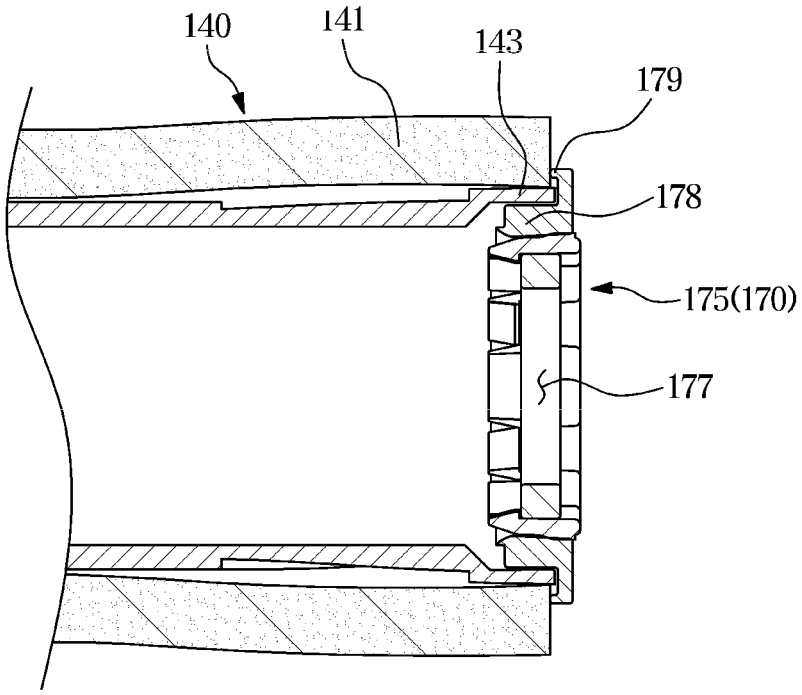
FIG. 5 shows an assembled state of the holder and the drum brush, according to an embodiment of the disclosure.

FIG. 4 shows a state in which a holder is assembled into a drum brush, according to an embodiment of the disclosure. FIG. 5 shows an assembled state of the holder and the drum brush, according to an embodiment of the disclosure.

As shown in FIGS. 4 and 5, the holders 170 may be detachably assembled with the sides of the drum brush 140. Because the first holder 171 and the second holder 175 have the same configuration, the first and second holders 171 and 175 may be collectively referred to as the holders 170. FIGS. 4 and 5 show a state in which the impeller 160 is separated from the second holder 175, for convenience of description, to describe assembling of the second holder 175 with the drum brush 140.

Each of the holders 170 may include a plurality of protrusions 178 that are detachably assembled with the drum brush 140. The drum brush 140 may include a plurality of concave portions 143 corresponding to the plurality of protrusions 178. The plurality of protrusions 178 may be in a shape of hooks. The plurality of concave portions 143 may be formed in a shape of grooves into which the plurality of protrusions 178 being in the shape of hooks are assembled. However, the plurality of protrusions 178 and the plurality of concave portions 143 may have any other structures capable of being detachably assembled with each other.

The drum brush 140 may include a brush 141 formed with villus and surrounding an outer circumferential surface of the drum brush 140. The brush 141 may be in a shape of a cylinder to surround the outer circumferential surface of the drum brush 140 having a cylinder shape.

The holder 170 may include a bent portion 179 overlapping a portion of one side of the brush 141 to prevent the brush 141 from being bitten upon assembling of the holder 170 with the side of the drum brush 140. The bent portion 179 may be bent toward the brush 141 in an axis direction of the drum brush 140. Because the bent portion 170 overlaps with the portion of the side of the brush 141, the brush 141 may be prevented from being bitten.

Figure 6:
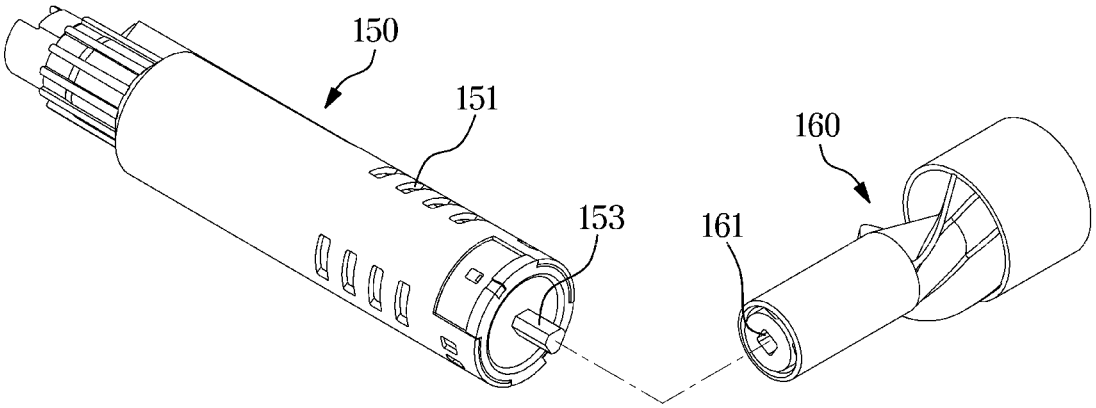
FIG. 6 shows a state in which an impeller is connected with a driver, according to an embodiment of the disclosure.

FIG. 6 shows a state in which an impeller is connected with a driver, according to an embodiment of the disclosure.

As shown in FIG. 6, the rotation shaft 153 of the driver 150 may be inserted into a rotation groove 161 of the impeller 160 to connect the driver 150 with the impeller 160. Accordingly, the impeller 160 may rotate together with the drum brush 140 (see FIGS. 12 and 13) rotating by the driver 150. The impeller 160 may rotate at the same velocity as a rotation velocity of the drum brush 140.

Figure 7:
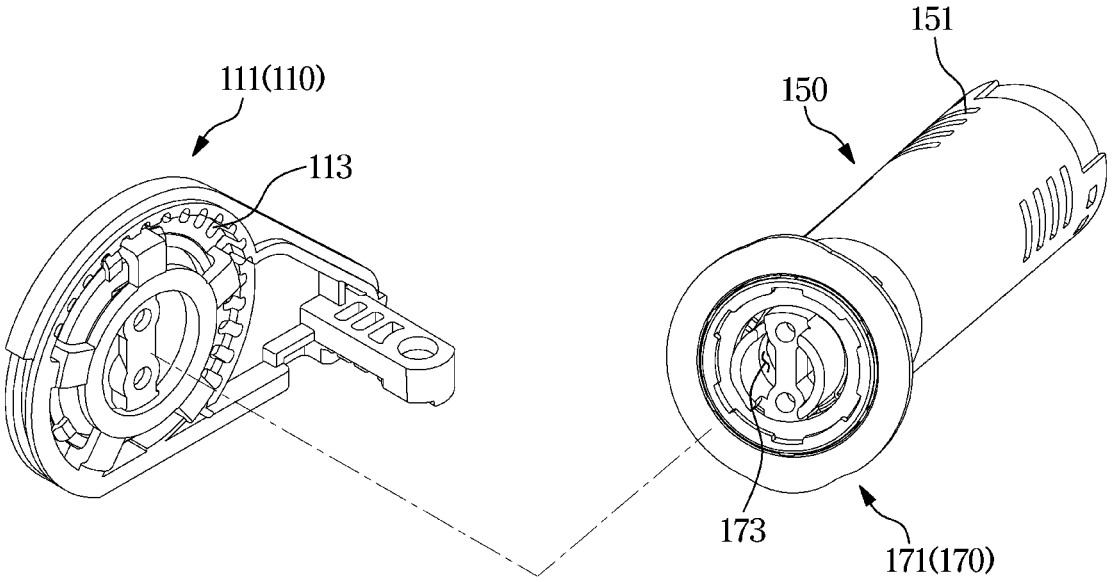
FIG. 7 shows a state in which a first cover is assembled into a first holder of a drum brush, according to an embodiment of the disclosure.
Figure 8:
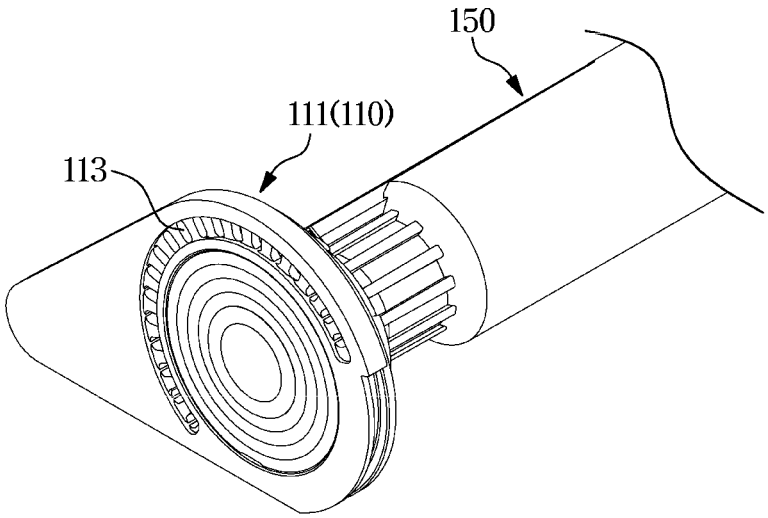
FIG. 8 shows an assembled state of the first cover and the first holder of the drum brush, according to an embodiment of the disclosure.
Figure 9:
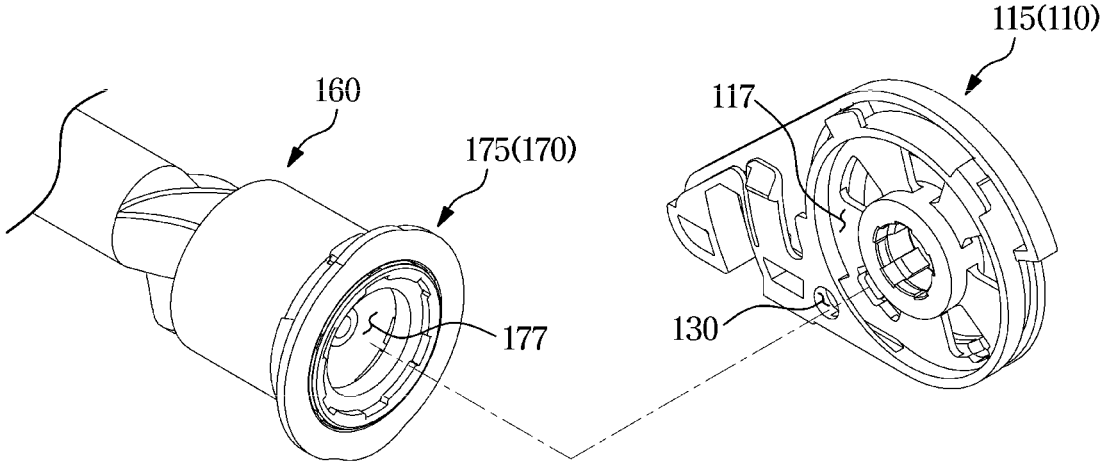
FIG. 9 shows a state in which a second cover is assembled into a second holder of a drum brush, according to an embodiment of the disclosure.
Figure 10:
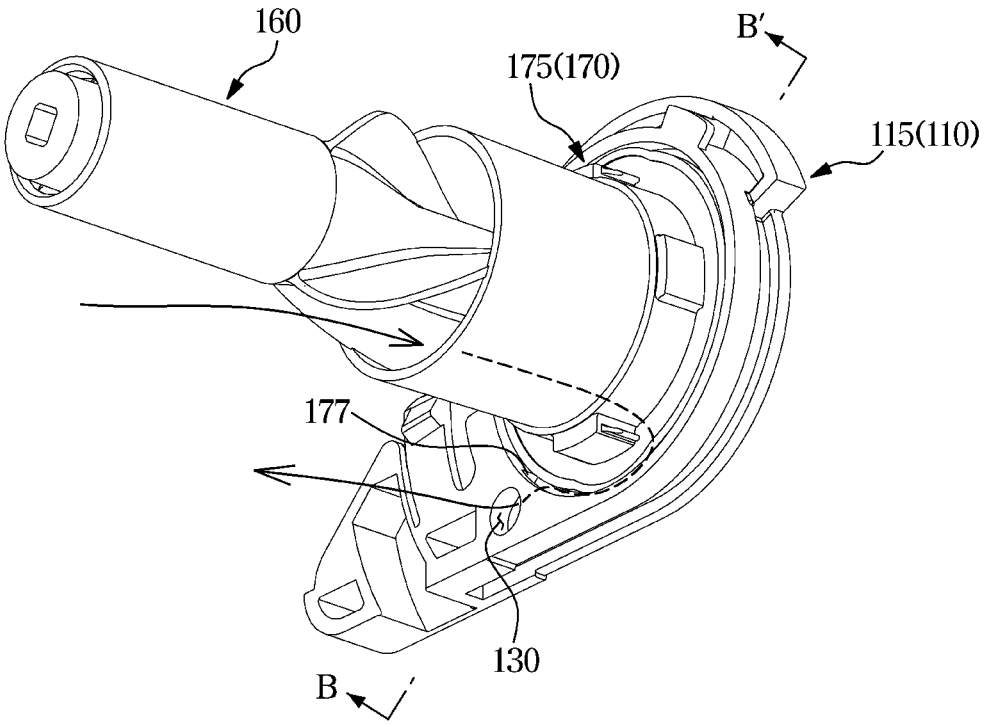
FIG. 10 shows an assembled state of the second cover and the second holder of the drum brush, according to an embodiment of the disclosure.
Figure 11:
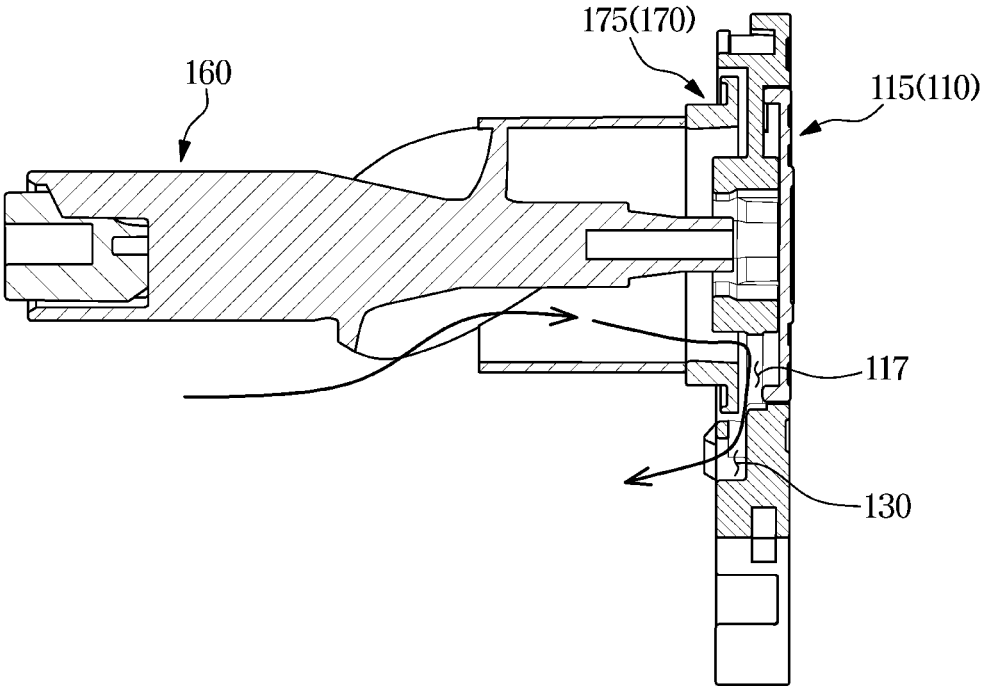
FIG. 11 is a cross-sectional view showing the assembled state of the second cover and the second holder of the drum brush, according to an embodiment of the disclosure.
Figure 12:
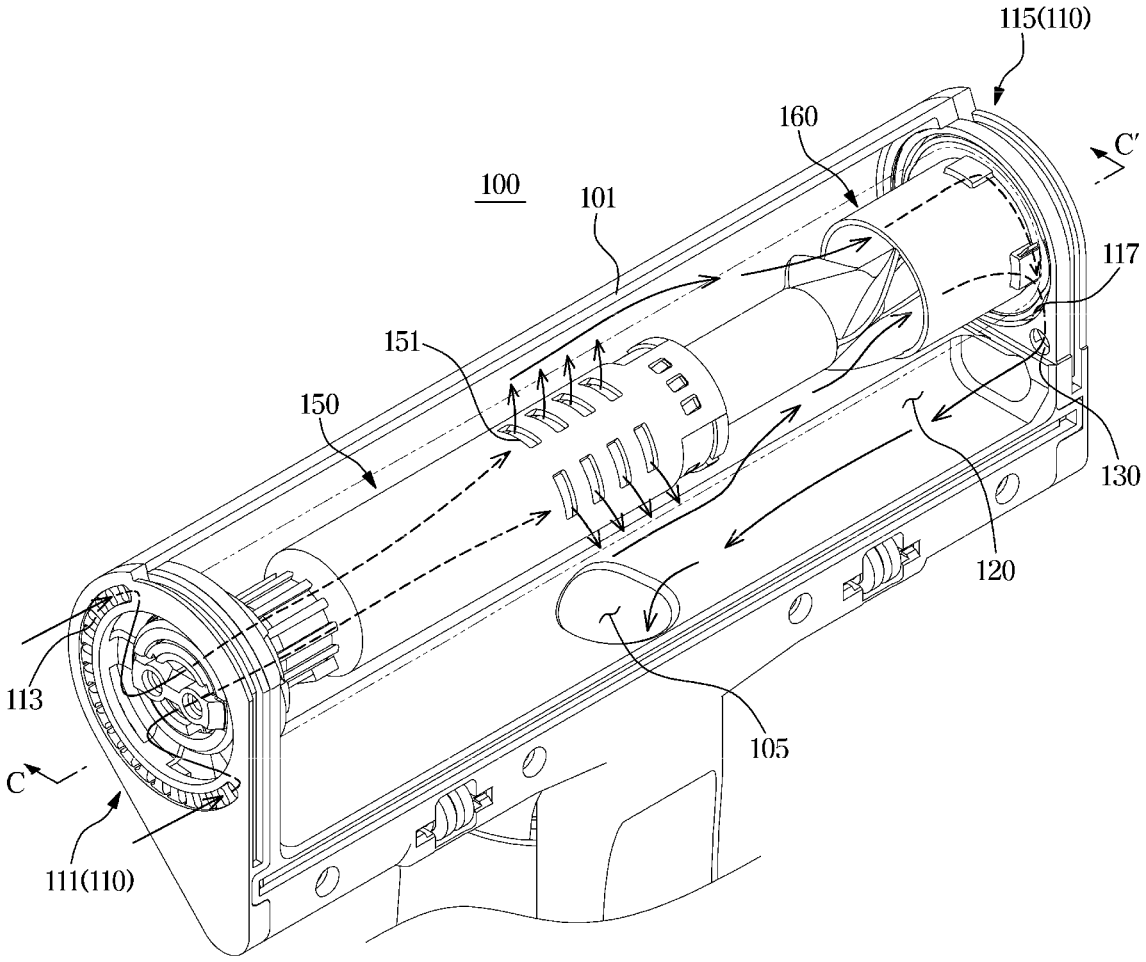
FIG. 12 shows a state in which outside air enters an inlet, cools inside of a drum brush, then is discharged to a suction chamber, and sucked through a suction inlet, according to an embodiment of the disclosure.
Figure 13:
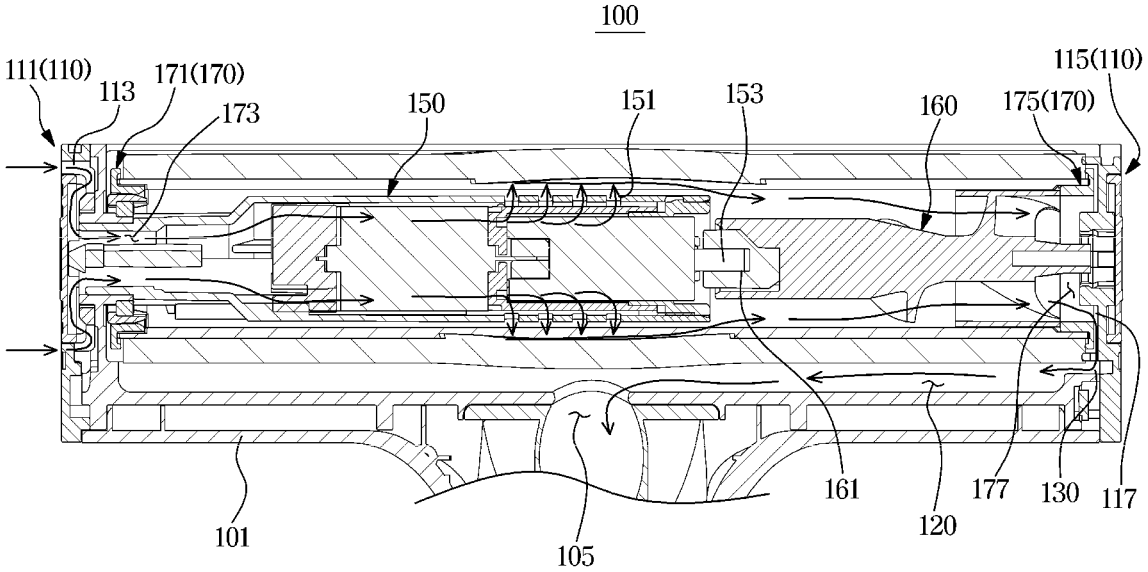
FIG. 13 is a cross-sectional view showing the state in which outside air enters the inlet, cools the inside of the drum brush, then is discharged to the suction chamber, and sucked through the suction inlet, according to an embodiment of the disclosure.

FIG. 7 shows a state in which a first cover is assembled into a first holder of a drum brush, according to an embodiment of the disclosure. FIG. 8 shows an assembled state of the first holder of the drum brush and the first cover, according to an embodiment of the disclosure. FIG. 9 shows a state in which a second cover is assembled into a second holder of a drum brush, according to an embodiment of the disclosure. FIG. 10 shows an assembled state of the second cover and the second holder of the drum brush, according to an embodiment of the disclosure. FIG. 11 is a cross-sectional view showing the assembled state of the second cover and the second holder of the drum brush, according to an embodiment of the disclosure. FIG. 12 shows a state in which outside air enters an inlet, cools inside of a drum brush, then is discharged to a suction chamber, and sucked through a suction inlet, according to an embodiment of the disclosure. FIG. 13 is a cross-sectional view showing the state in which outside air enters the inlet, cools the inside of the drum brush, then is discharged to the suction chamber, and sucked through the suction inlet, according to an embodiment of the disclosure.

As shown in FIGS. 7 to 13, an inlet 113 through which outside air enters the inside of the drum brush 140 may be formed in the first cover 111. The inlet 113 may be a plurality of holes. The inlet 113 may be formed so that air is introduced in order to discharge heat generated inside the drum brush 140 by the driver 150 provided inside the drum brush 140 to the outside. That is, outside air entered the drum brush 140 through the inlet 113 may enter the inside of the driver 150 provided inside the drum brush 140 through the first opening 173 formed in the first holder 171.

In the inlet 113, a filter for filtering a foreign material such as dust entering the inlet 113 together with outside air may be provided, and the filter is not shown in the drawings.

According to an operation of the suction motor 11 (see FIG. 1) that generates a suction force, negative pressure may be formed inside the suction chamber 120 communicating with the suction inlet 105. By the negative pressure formed inside the suction chamber 120, outside air may enter the inside of the drum brush 140 through the inlet 113.

In the second cover 115, an outlet duct 117 through which air entered the inside of the drum brush 140 through the inlet 113 is discharged to the suction chamber 120 may be formed. The outlet duct 117 may communicate with the second opening 177 formed in the second holder 175. The outlet duct 117 may communicate with the suction chamber 120 through an outlet 130.

The outlet 130 may be formed in the second cover 115 forming a portion of side walls of the suction chamber 120. The outlet 130 may be in a shape of a circle. However, the shape of the outlet 130 is not limited to a circle shape.

Accordingly, outside air entered the inlet 113 by negative pressure formed in the suction chamber 120 may enter the inside of the driver 150 through the first opening 173 formed in the first holder 171. The air entered the inside of the driver 150 may cool the inside of the driver 150, and then be discharged to the outside of the driver 150 through the exhaust hole 151 formed in the driver 150. Air discharged to the inside of the drum brush 40, which is the outside of the driver 140, through the exhaust hole 151 may be discharged to the outlet duct 117 through the second opening 177 formed in the second holder 175. The air discharged to the outlet duct 117 may be discharged to the suction chamber 120 through the outlet 130. The air discharged to the suction chamber 120 may be sucked into the main body 10 (see FIG. 1) through the suction inlet 105.

As described above, an internal flow path of the brush head 100 may be a serial type flow path along which outside air entered the inside of the brush head 100 through the inlet 113 cools the inside of the drum brush 140, and then is discharged to the suction chamber 120 through the outlet duct 117. To form the internal flow path of the brush head 100 as a serial type flow path, one of the covers 110 covering both sides of the brush head 100 may seal the inside of the brush head 100. In the other one of the covers 110, the inlet 113 may be formed to enable air to enter the inside of the brush head 100 from the outside. That is, one of the pair of covers 110 may communicate with the outside, and the other one may be blocked from the outside. In the drawings, the first cover 111 is shown to include the inlet 113, and the second cover 115 is shown to be blocked from the outside, although not limited thereto. That is, the second cover 115 may include the inlet 113, and the first cover 111 may be blocked from the outside. In this case, the driver 150 and the impeller 160 may be positioned in reverse. That is, the driver 150 may be adjacent to the second cover 115 through which air enters, and the impeller 160 may be adjacent to the first cover 111 blocked from the outside.

The impeller 160 may be coupled with the second holder 175 and provided inside the drum brush 140. As described above, outside air may enter the inlet 113 by negative pressure formed in the suction chamber 120, cool the inside of the drum brush 140, and then be discharged to the suction chamber 120 through the outlet duct 117. The impeller 160 may improve a flow of air flowing along the serial type flow path. That is, upon a rotation of the drum brush 140 by the driver 150, a flow of air cooling the inside of the drum brush 140 may be improved by the impeller 160 rotating together with the drum brush 140.

Figure 14:
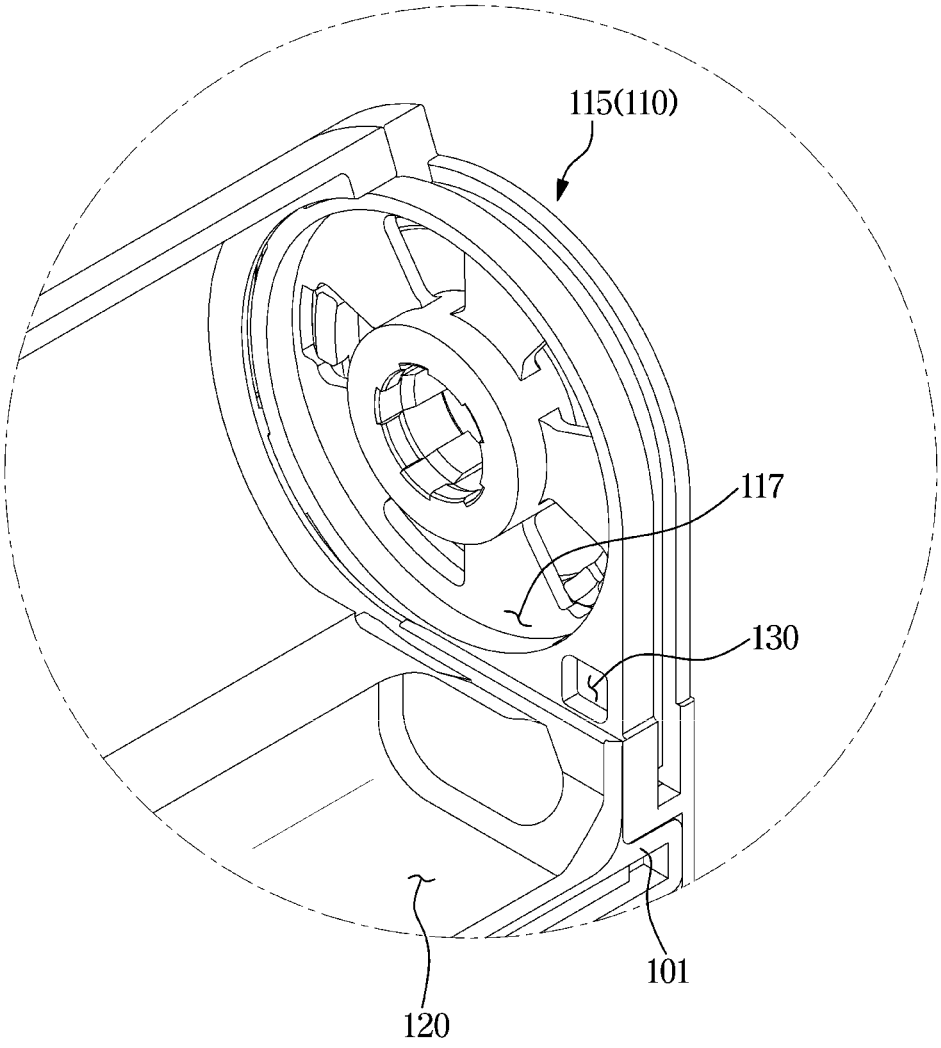
FIG. 14 shows an outlet formed in a quadrangle shape, according to an embodiment of the disclosure.

FIG. 14 shows an outlet formed in a quadrangle shape, according to an embodiment of the disclosure.

As shown in FIG. 14, the outlet 130 may be in a shape of a quadrangle, instead of a circle shape. In the drawing, the outlet 130 is shown to be formed in a shape of a quadrangle, although not limited thereto. That is, the outlet 130 may be formed in a shape of a polygon including a quadrangle.

Figure 15:
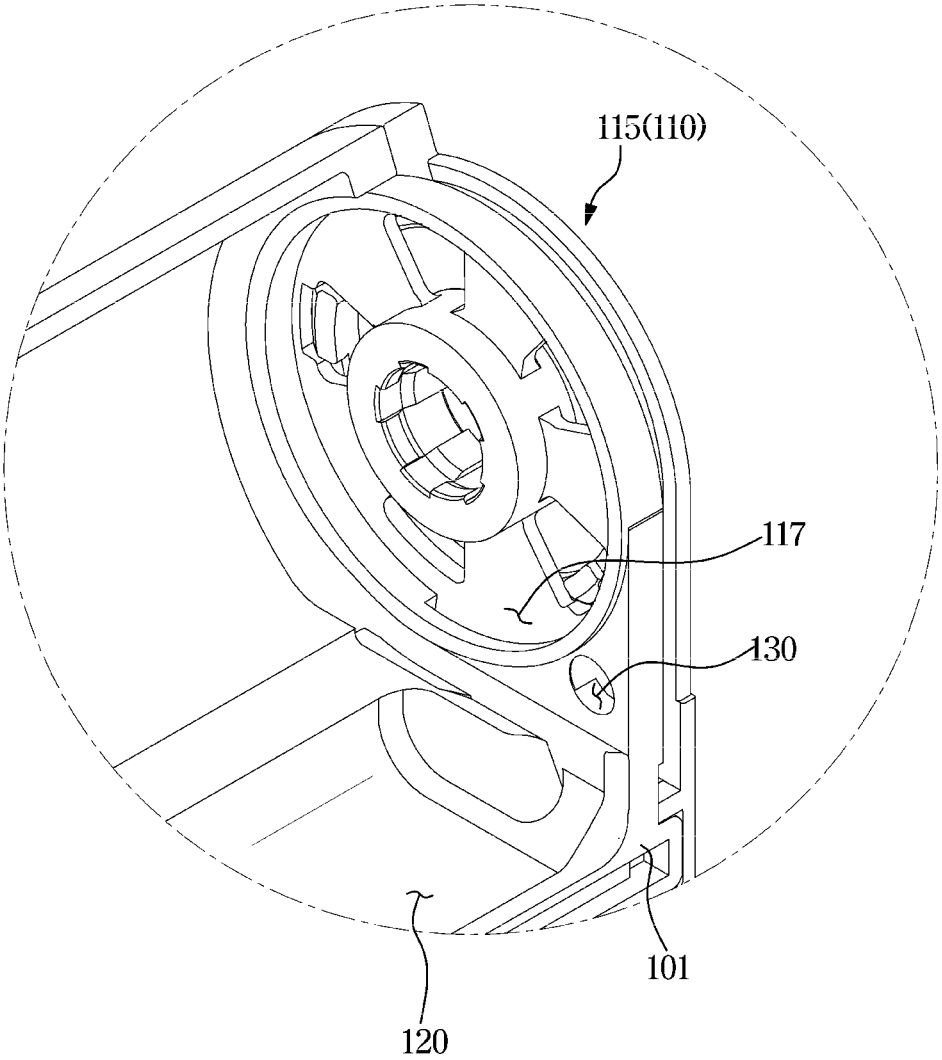
FIG. 15 shows an outlet formed in a side wall of a brush head, according to an embodiment of the disclosure.
Figure 16:
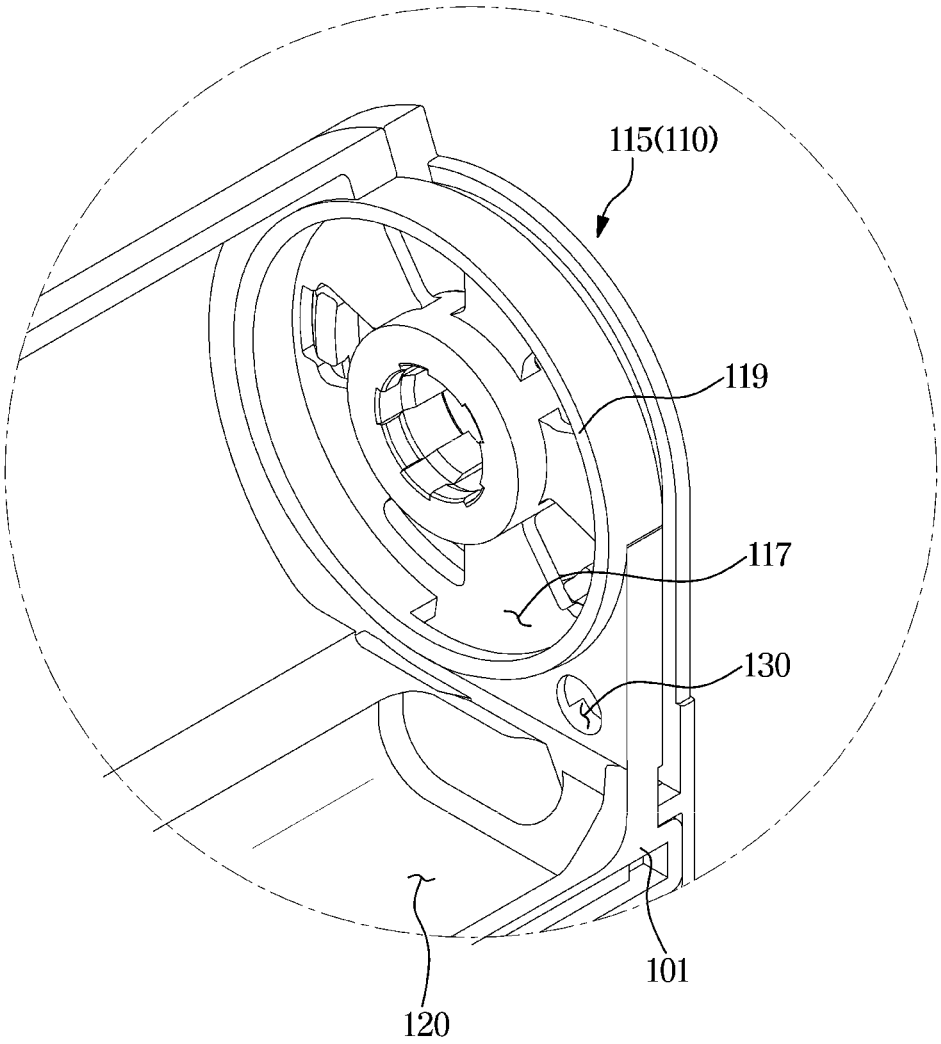
FIG. 16 shows an outlet formed in a side wall of a brush head and a guide formed in a second cover, according to an embodiment of the disclosure.

FIG. 15 shows an outlet formed in a side wall of a brush head, according to an embodiment of the disclosure. FIG. 16 shows an outlet formed in a side wall of a brush head and a guide formed in a second cover, according to an embodiment of the disclosure.

As shown in FIG. 15, the outlet 130 may be formed in a side wall of the brush head 100, forming a portion of the side walls of the suction chamber 120. The outlet 130 may be formed at any location to enable the outlet duct 117 to communicate with the suction chamber 120 to discharge air to the suction chamber 120.

As shown in FIG. 16, in a case in which the outlet 130 is formed in the side wall of the brush head 100, forming a portion of the side walls of the suction chamber 120, a guide 119 may be formed in the second cover 115 to prevent the drum brush 140 from interfering with the outlet 130. The guide 119 may be in a shape of a cylinder. The guide 119 may protrude in the axial direction of the drum brush 140, and prevent the drum brush 140 from interfering with the outlet 130.

According to embodiments of the disclosure, heat generated inside the drum brush may be rapidly cooled.

While the above descriptions about the cleaner, given with reference to the accompanying drawings, are based on specific shapes and directions, various modifications and changes may be made by those of skilled in the art, and such various modification and changes should be interpreted to be included in the scope of rights of the disclosure.

What is claimed is:

1. A cleaner comprising:

a main body;

a connection pipe having one end connectible to the main body and an other end; and a brush head connectible to the other end of the connection pipe;

wherein the brush head comprises:

a first cover to cover one side of the brush head, the first cover having an inlet;

a second cover to cover an other side of the brush head, the second cover having an outlet duct;

a drum brush configured to catch a foreign material from a floor by rotating;

a suction inlet configured to move the foreign material to the main body through the connection pipe;

a driver disposed inside of the drum brush, and configured to rotate the drum brush, the driver having:

one end connected to the inlet of the first cover so that outside air of the brush head directly enters into the driver through the inlet of the first cover;

an other end; and a plurality of exhaust holes through which air inside of the driver discharges into the inside of the drum brush;

an impeller disposed inside of the drum brush, the impeller having:

one end connected to the other end of the driver to be rotated together with the drum brush; and an other end connected to the outlet duct of the second cover so that air inside of the drum brush is drawn into the outlet duct by a rotation of the impeller, wherein the outside air enters through the inlet of the first cover to introduce directly into the one end of the driver to cool the inside of the driver, discharges from the driver through the plurality of exhaust holes to the inside of the drum brush, is guided to the outlet duct of the second cover by the impeller, and flows through the suction inlet to the connection pipe.

2. The cleaner of claim 1, wherein the brush head further comprises a suction chamber formed inside thereof, wherein the cleaner further comprises a suction motor installed inside the main body and configured to generate a suction force to form negative pressure inside the suction chamber, and wherein the outside air enters the brush head through the inlet by the negative pressure formed inside the suction chamber to cool the inside of the drum brush, and then the outside air is discharged to the suction chamber through the outlet duct.

3. The cleaner of claim 1, wherein the brush head further comprises a suction chamber formed inside thereof, and wherein the inlet includes a plurality of holes formed therein and through which the outside air directly enters, and an internal flow path of the brush head is formed as a serial type flow path along which the outside air enters through the plurality of holes of the inlet, cools the inside of the drum brush, and then is discharged to the suction chamber through the outlet duct.

4. The cleaner of claim 3, wherein the first cover has a circular shaped body and the plurality of holes of the inlet is formed in the circular shaped first cover so that the outside air directly enters through the plurality of holes of the inlet.

5. The cleaner of claim 1, wherein the impeller configured to improve a flow of air entering the inlet, and passing through the inside of the driver and the inside of the drum brush, and discharging through the outlet duct.

6. The cleaner of claim 1, wherein the drum brush comprises a pair of holders detachably assembled with both sides of the drum brush.

7. The cleaner of claim 6, wherein the pair of holders comprise a first holder detachably assembled with one side of the drum brush, and adjacent to the first cover, the first holder coupled with the driver, and a second holder detachably assembled with an other side of the drum brush, and adjacent to the second cover, the second holder coupled with the impeller.

8. The cleaner of claim 7, wherein the drum brush further comprises a brush formed with villus and formed in a shape of a cylinder to surround an outer circumferential surface of the drum brush.

9. The cleaner of claim 8, wherein each of the first holder and the second holder comprises a bent portion overlapping a portion of one side of the brush and bent toward the brush in an axial direction of the drum brush.

10. The cleaner of claim 1, wherein the impeller rotates at a same rotation velocity as a rotation velocity of the drum brush upon a rotation of the drum brush.

11. The cleaner of claim 1, wherein the brush head further comprises a suction chamber formed inside thereof, and the cleaner further comprises an outlet configured to enable the outlet duct to communicate with the suction chamber and discharge air passed through the outlet duct to the suction chamber.

12. The cleaner of claim 11, wherein the outlet is formed in the second cover forming a portion of side walls of the suction chamber.

13. The cleaner of claim 11, wherein the outlet is formed in a side wall of the brush head, the side wall forming a portion of side walls of the suction chamber.

14. The cleaner of claim 13, wherein the second cover further comprises a guide protruding in an axial direction of the drum brush and configured to prevent the drum brush from interfering with the outlet.

15. The cleaner of claim 11, wherein the outlet is formed in a shape of a circle.

16. The cleaner of claim 11, wherein the outlet is formed in a shape of a polygon.

17. The cleaner of claim 1, wherein the impeller is installed inside the drum brush, and configured to improve a flow of air in an internal flow path by rotating together with the drum brush, and wherein the impeller guides the discharged air from the driver and the air inside of the drum brush to the outlet duct.

* * * * *